US006350208B1

(12) United States Patent
Ford

(10) Patent No.: US 6,350,208 B1
(45) Date of Patent: Feb. 26, 2002

(54) GOLF PUTTER

(76) Inventor: Thomas R. Ford, 143 Whims La., Rochester, MI (US) 48306

( * ) Notice: Subject to any disclaimer, the term of this patent is extended or adjusted under 35 U.S.C. 154(b) by 0 days.

(21) Appl. No.: 09/490,715

(22) Filed: Jan. 25, 2000

(51) Int. Cl.[7] ..... A63B 69/36; A63B 53/04

(52) U.S. Cl. ..... 473/249; 473/251; 473/313; 473/340

(58) Field of Search ..... 473/313, 314, 473/340, 341, 251, 252, 253, 254, 255, 238, 242, 244, 305, 350, 349, 249; D21/736, 742, 743, 744, 745, 746

(56) References Cited

U.S. PATENT DOCUMENTS 1,250,296 A * 12/1917 Fitzjohn
3,819,180 A * 6/1974 Murphy
4,174,839 A * 11/1979 Marrs
4,659,083 A * 4/1987 Szczepanski
4,795,157 A * 1/1989 Bencriscutto
4,815,739 A * 3/1989 Donica
4,819,943 A * 4/1989 Szczepanski
5,160,141 A * 11/1992 Crews
5,267,733 A * 12/1993 Szokola
5,830,078 A * 11/1998 McMahan

* cited by examiner

*Primary Examiner*—Sebastiano Passaniti
(74) *Attorney, Agent, or Firm*—John R. Benefiel

(57) ABSTRACT

A golf putter has a putter head which is ring shaped with a flattened front wall defining a striking face. A hosel is supported by a web cantilevered from a rear wall to locate the hosel at the center of mass of the putter head, to minimize any tendency for twisting as the ball is struck. Sighting marks are recessed into the web and at the top center of the front wall.

9 Claims, 5 Drawing Sheets

GOLF PUTTER

BACKGROUND OF THE INVENTION

This invention concerns golf putters, and more particularly putter heads.

A great many putter head configurations have been devised in an effort to improve the ability of a golfer to execute accurate putts, as by providing particular sighting marks, offset connections between the shaft and head, etc.

One factor in properly executing most golf shots is to minimize the twisting of the shaft as the head strikes the ball. This is avoided when the "sweet spot" strikes the ball squarely as twisting forces are thereby avoided, but unless a perfect stroke is made, slight twisting forces act on the head. This twisting of the putter head in turn causes inaccurate putting.

While there have previously been proposed roughly ring shaped putter heads tending to increase the moment of inertia of the putter head, the attachment of the putter shaft in those designs have been such as to create an imbalance of the putter head on the shaft tending to create slight twisting when the ball is stroked.

The object of the invention is to provide a particular putter which is resistant to twisting movement induced by striking the ball during execution of a putting stroke.

SUMMARY OF THE INVENTION

The above object as well as others which will be apparent upon a reading of the following specification and claims are accomplished by a putter head configuration and shaft attachment which increases the moment of inertia of the putter head about the shaft axis over conventional putters such as to reduce the tendency for twisting by means of an increased inertial resistance to turning. At the same time, the putter head is symmetrically arranged with respect to the shaft axis to eliminate imbalances of the putter head on the shaft when stroking the ball.

The putter head is configured as a ring flattened on the front side, with the shaft attachment within the ring located at the center of mass of the putter head, connected by a web extending radially along the line of sight from the inside of the wall defining the ring shape. The flattened front wall of the ring shape defines the striking face of the putter head.

A special arrangement of sighting marks is preferably disposed on the shaft socket web and on the top of the front wall to assist in proper alignment of the putter head with a desired path of the ball to the cup.

DETAILED DESCRIPTION

Figure 2:
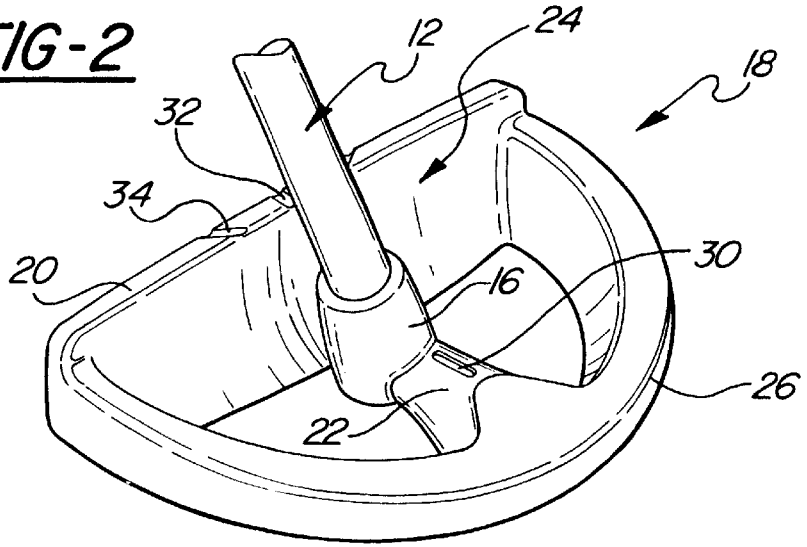
FIG. 2 is an enlarged perspective view of the head of the golf putter shown in FIG. 1 with a fragmentary portion of the putter shaft.

In the following detailed description, certain specific terminology will be employed for the sake of clarity and a particular embodiment described in accordance with the requirements of 35 USC 112, but it is to be understood that the same is not intended to be limiting and should not be so construed inasmuch as the invention is capable of taking many forms and variations within the scope of the appended claims.

FIGS. 1–12 show a golf putter 10 according to the present invention, including a shaft 12 with a grip section 14 at the upper end, of conventional construction.

The shaft 12 has its lower end received in a socket or hosel 16 integral with the putter head 18 so that the axis of the shaft is aligned with the hosel. The axis of the hosel 16 is inclined to one side so that the axis of the shaft 12 is also aligned towards the golfer holding the putter.

Figure 3:
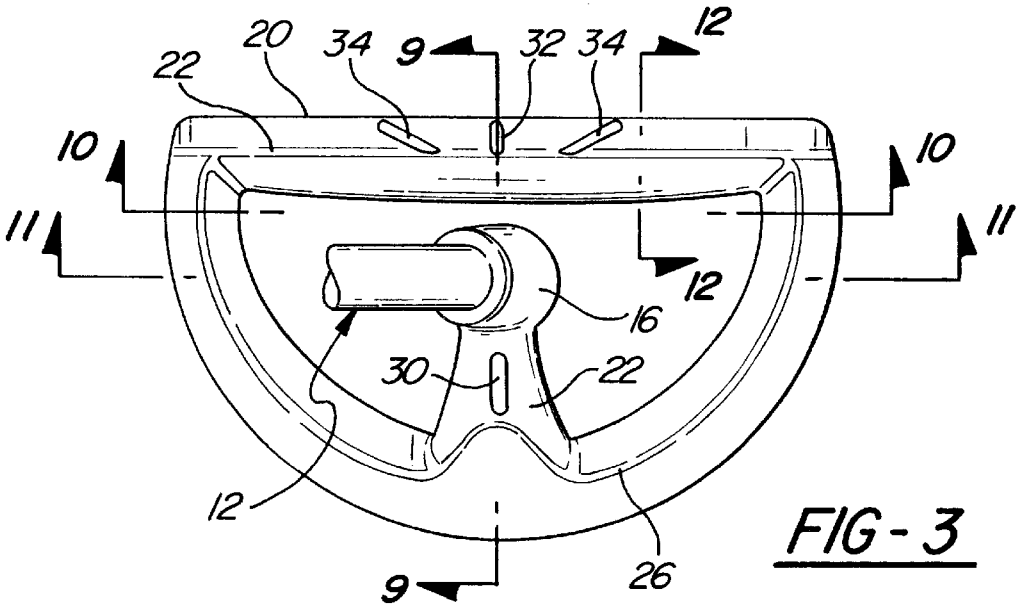
FIG. 3 is a plan view of the putter head shown in FIG. 2.
Figure 1:
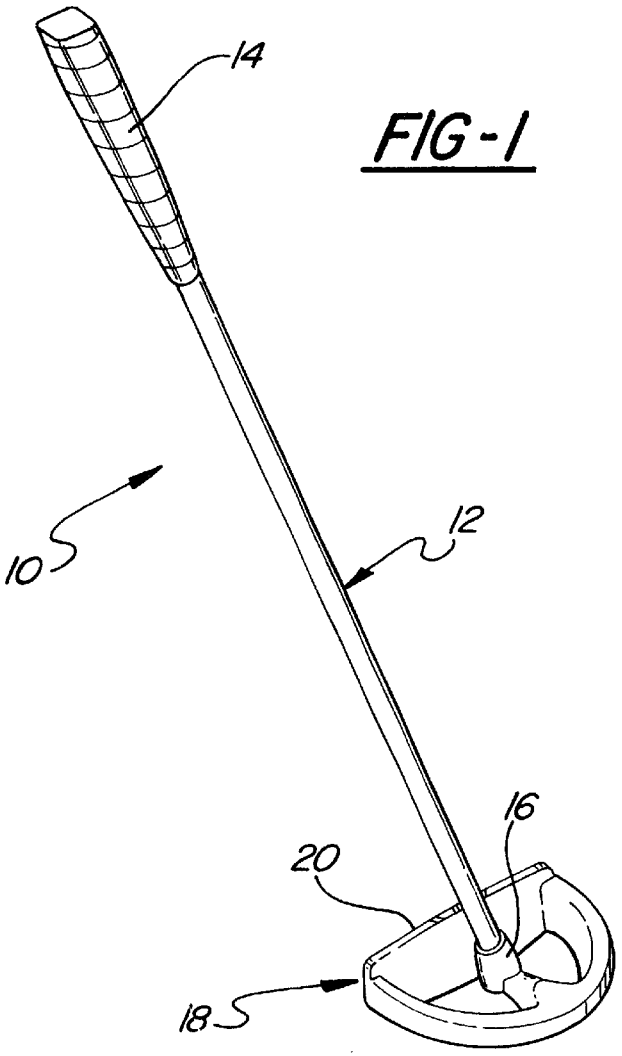
FIG. 1 is a perspective view of a golf putter according to the present invention.
Figure 6:
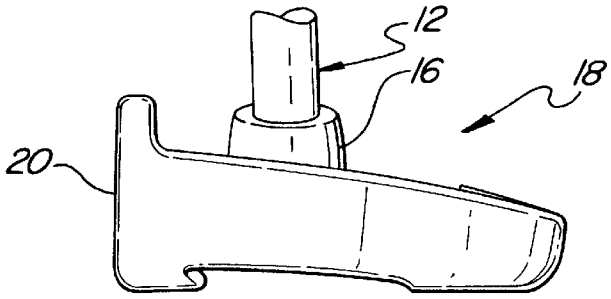
FIG. 6 is a right side view of the putter head shown in FIG. 2.
Figure 7:
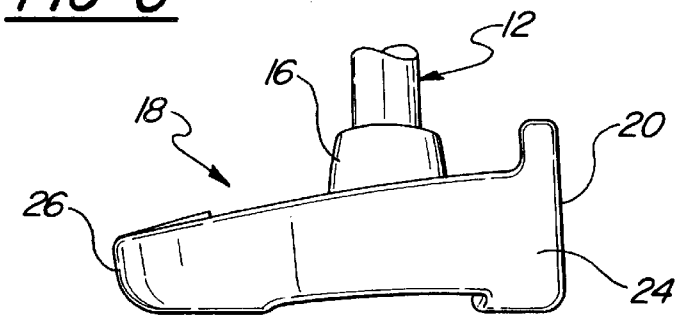
FIG. 7 is a left side view of the putter head shown in FIG. 2.
Figure 8:
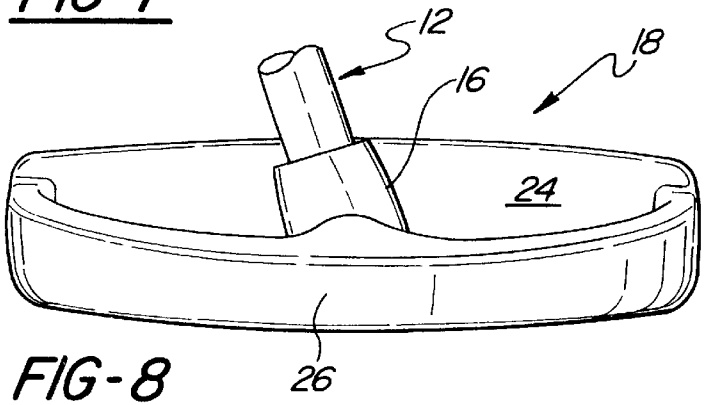
FIG. 8 is a rear view of the putter head shown in FIG. 2.
Figure 4:
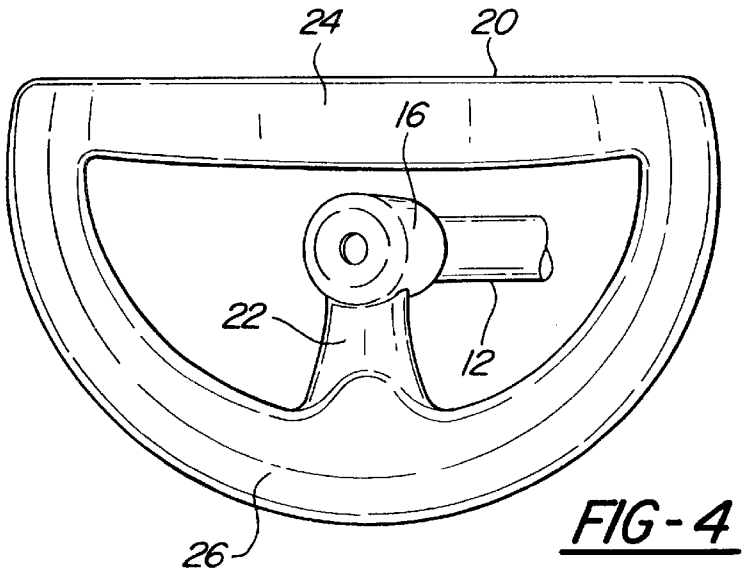
FIG. 4 is a bottom view of the putter head shown in FIG. 2.
Figure 5:
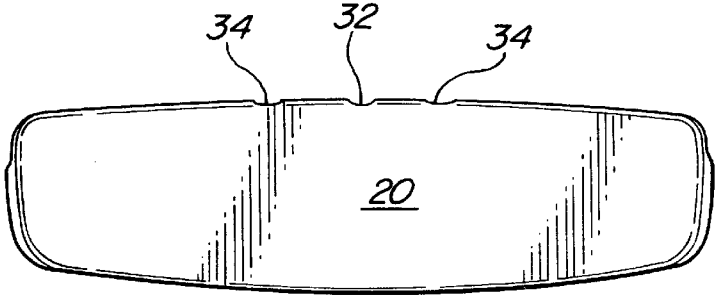
FIG. 5 is a front view of the putter head shown in FIG. 2.
Figure 10:
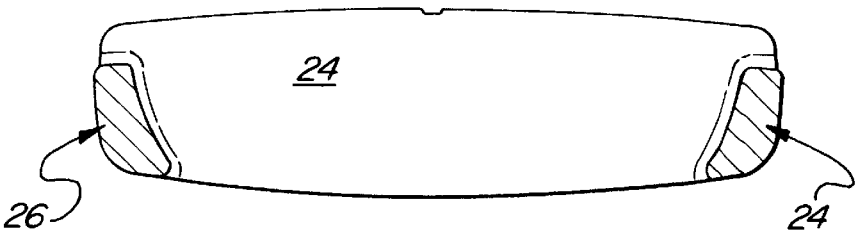
FIG. 10 is a view of the section taken through the putter head shown in FIG. 3 along the lines 10—10.
Figure 12:
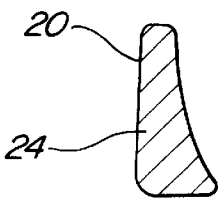
FIG. 12 is a view of a section taken through the putter head in FIG. 3 along the line 12—12.
Figure 9:
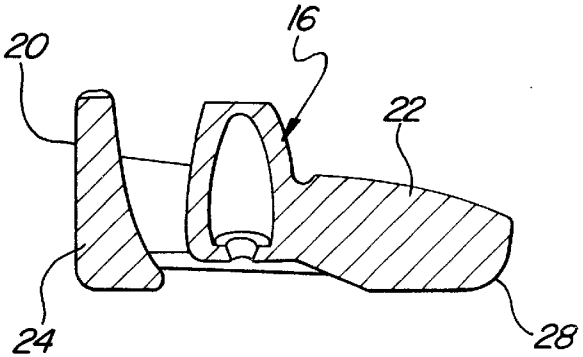
FIG. 9 is a view of the section taken through the putter head shown in FIG. 3 along the lines 9—9.
Figure 11:
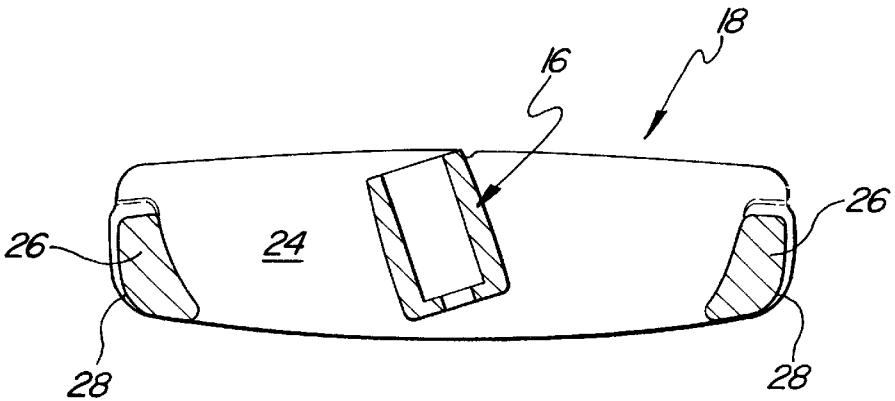
FIG. 11 is a view of the section taken through the putter head shown in FIG. 3 along the lines 11—11.

The putter head 18, constructed of cast metal, is shaped as a ring flattened along the front wall 24, comprising the front, striking face 20 of the putter head 18, (FIGS. 3, 6).

A support web 22 extends in radially from the center of the arcuate rear wall 26 of the putter head 18, and cantilevered therefrom so as to dispose the hosel 16 and attachment of the shaft 12 at the approximate center of mass of the putter head 18 (FIG. 3). The support web 22 is aligned with the projected path of the ball to be putted. The putter head 18 is thus symmetrically arranged with respect to the shaft axis.

As noted, the front wall 24 has the striking face 20 formed thereon, which is of greater height and mass than the rear wall 26 (FIGS. 9–12), so that the hosel 16 is located much nearer the front wall 24 when located at the center of the mass of the putter head 18. This configuration also locates the center of mass of the putter head close behind the spot at which the ball is to be struck on the front face 20, minimizing any slight twisting reaction in the shaft 12 if the ball is not stroked exactly on center.

The rear wall 26 has rounded comers 28 at the bottom to reduce any tendency for scuffing as the putter is stroked.

A sighting mark 30 is recessed into the top of the web 22, and a second mark 32 aligned therewith is recessed into the top of the front wall 24 (FIG. 3). Outwardly angled auxiliary ball centering sighting marks 34 are also recessed into the top of the front wall 22 diverging outwardly from each other in the direction towards the front face 20. The sighting marks 30, 32 are in line with the hosel 16, and the axis of the shaft 12 extends perpendicularly to the sighting axis.

Accordingly, the flattened ring shape maximizes the moment of inertia of the putter head, while the location of the shaft attachment within the ring at the center of mass insures balancing of the head on the shaft 12. The shaft attachment is at a point in alignment with the projected path of the ball, to further minimize twisting when the ball is stroked.

The sighting marks 30, 32 in turn are in line with the hosel 16, with the sighting axis perpendicular to the shaft axis, to also improve putting accuracy.

Figure 14:
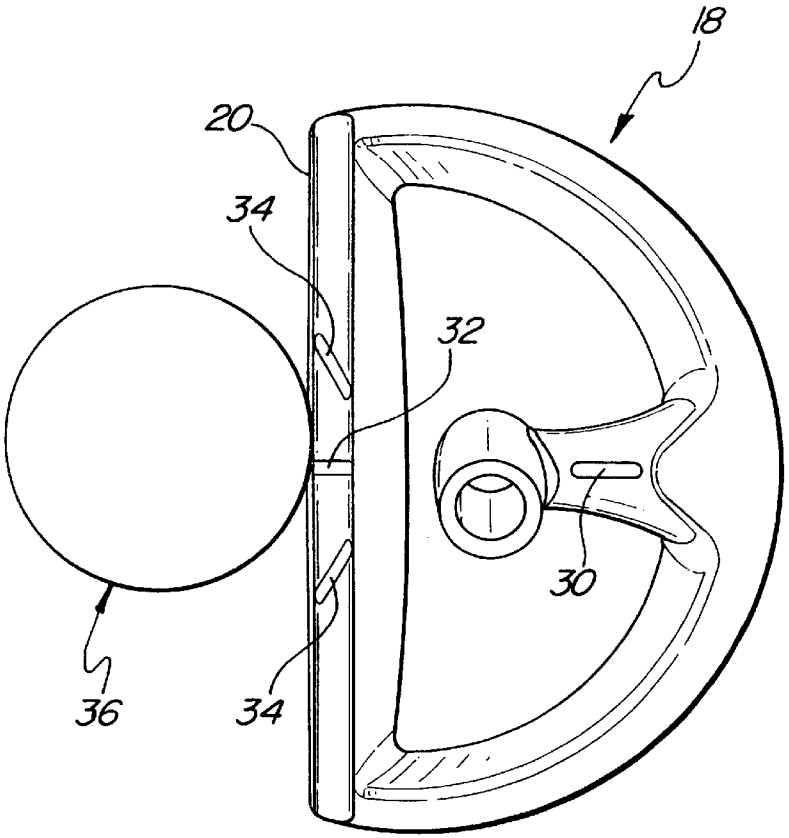
FIG. 14 is a plan view of a putter head and golfball when misaligned with the sighting marks.
Figure 13:
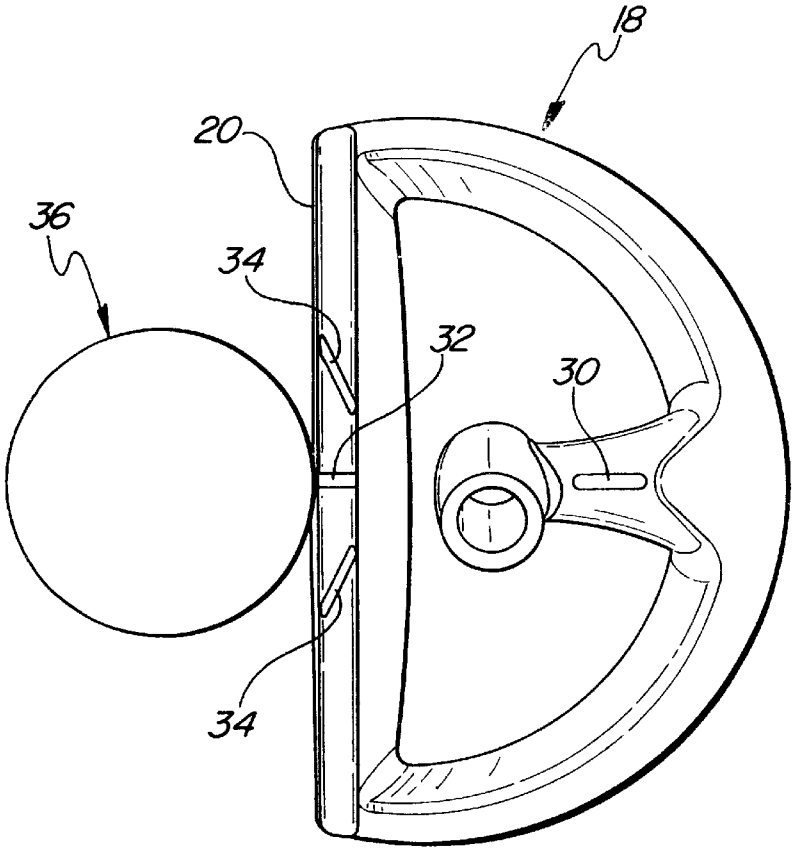
FIG. 13 is a plan view of a putter head and golf ball at the point of impact when properly aligned with the sighting marks.
Figure 16:
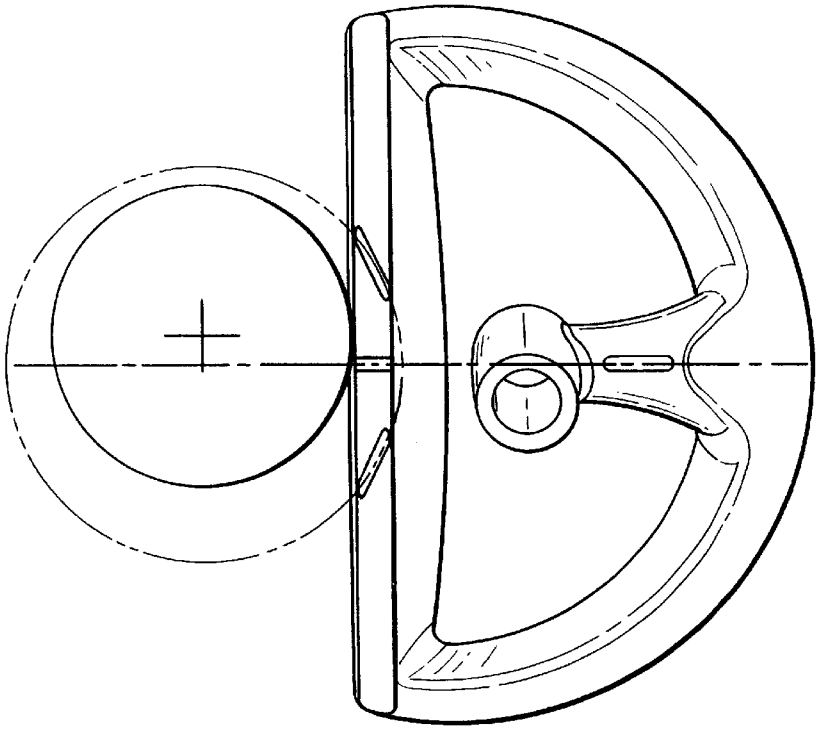
FIG. 16 is a diagram of the putter head and ball showing how the sighting marks and in aligning the ball on center.
Figure 15:
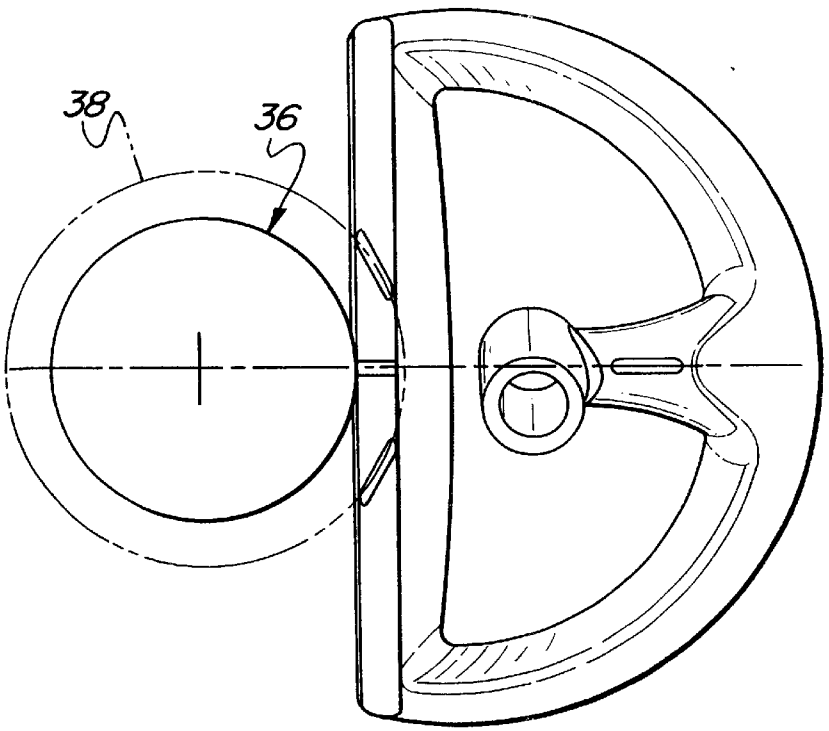
FIG. 15 is a diagram of the putter head and ball, showing the function of the sighting marks, with the ball on center.

FIGS. 13–16 show how the angled sighting marks 34 assist in aligning a golf ball 36 with the center line at the sweet spot on the striking face 20 of the putter 18. The sighting marks 34 diverge tend to create the perception of a circle 38 of larger radius than the golf ball 36. Any eccentricity of the golf ball 36 in the circle 38 is readily apparent to the eye, as there is a natural ability to align these like shapes. Thus, misalignments as shown in FIGS. 14 and 16 are easily detected and corrected.

What is claimed is:

1. A golf putter comprising:

an elongated shaft defining a shaft axis;

a putter head configured as an approximate ring, with a striking face defined by a flattened front wall of said ring, and with an arcuate rear wall;

a web extending radially in from the rear wall, and a hosel on the end of the web, one end of said shaft received in said hosel to align the shaft axis with said hosel;

said hosel located at the center of mass of said putter head so that said putter head is symmetrically arranged with respect to said shaft axis.

2. The golf putter according to claim 1 wherein said center of mass is located behind said front wall.

3. The golf putter according to claim 1 wherein a sighting mark is on a top surface of said web.

4. The golf putter according to claim 3 wherein a second sighting mark is on a top surface of said putter head adjacent said front wall, said second sighting mark aligned with said mark on said web.

5. The golf putter according to claim 4 wherein said hosel is inclined to the one side of said putter head to angle said shaft towards a holder while remaining perpendicular to said sighting marks.

6. The golf putter according to claim 4 wherein said sighting marks are aligned with the center of mass of said putter head.

7. The golf putter according to claim 1 wherein said web is cantilevered from the rear wall of said putter head, extending radially in alignment with a center axis of said putter head.

8. The golf putter according to claim 6 further including an outwardly angled sighting marks equally spaced from a respective each side of said second sighting mark, said angled marks diverging in the direction towards said striking face and forming segments of an imaginary circle lying forward of said striking face and of a substantially larger diameter than a golf ball, said top surface not having any other sighting marks thereon.

9. A sighting mark arrangement for a putter, including a putter head having a striking face on one side, said sight mark arrangement including a sighting mark on a top surface of said putter head adjacent said striking face, said sighting mark extending along a centerline of said putter head, and an outwardly angled auxiliary sighting mark equally spaced from each side of said sighting mark diverging from each other in the direction towards said striking face and forming segments of an imaginary circle lying forward of said striking face and of a substantially larger diameter than a golf ball, said top surface not having any other sighting marks thereon.

* * * * *